US010549416B2

(12) United States Patent
Fiala et al.

(10) Patent No.: US 10,549,416 B2
(45) Date of Patent: Feb. 4, 2020

(54) GUIDE FOR A FASTENER HAND TOOL

(71) Applicant: Paul E. Fiala, Downey, CA (US)

(72) Inventors: Paul E. Fiala, Anaheim, CA (US); Cameron Munson, Paramount, CA (US)

( * ) Notice: Subject to any disclaimer, the term of this patent is extended or adjusted under 35 U.S.C. 154(b) by 507 days.

(21) Appl. No.: 15/177,164

(22) Filed: Jun. 8, 2016

(65) Prior Publication Data

US 2016/0354919 A1 Dec. 8, 2016

Related U.S. Application Data

(60) Provisional application No. 62/230,565, filed on Jun. 8, 2015.

(51) Int. Cl.
*B25H 1/00* (2006.01)
*B25C 7/00* (2006.01)

(52) U.S. Cl.
CPC ..... *B25H 1/0078* (2013.01); *B25C 7/00* (2013.01)

(58) Field of Classification Search
CPC .... B25C 1/00; B25C 1/04; B25C 1/08; B25C 5/16; B25C 7/00; A47B 88/43; A47B 88/49; A47B 88/57; A47B 96/067; A47B 96/07; A47B 2088/4235; A47B 2210/0032; A47B 61/02; A47B 88/40; A47B 88/407; A47B 88/42; A47B 88/427; A47B 88/45; A47B 88/493; A47B 96/1458; A47B 2021/0335; A47B 2088/422; A47B 2088/4276; A47B 2088/4278; A47B 21/02; A47B 21/0314; A47B 2200/0042; A47B 2200/0046; A47B 2210/007; A47B 2210/0072; A47B 2210/0081;

(Continued)

(56) References Cited

U.S. PATENT DOCUMENTS 1,541,518 A 2/1925 McCain
2,462,959 A * 3/1949 Hardy ..... B25D 1/02 81/25

(Continued)

OTHER PUBLICATIONS

Artek, Duravar UHMW-PE Ultra-High Molecular Weight Polyethylene, Sep. 2013, Arteck.*

(Continued)

*Primary Examiner* — Robert F Long
*Assistant Examiner* — Christopher Robin Kim
(74) *Attorney, Agent, or Firm* — Canady & Lortz LLP; Bradley K. Lortz

(57) ABSTRACT

A guide for a fastener hand tool is disclosed including a truck having slidable engagement with a track affixed to the fastener hand tool. The slidable engagement comprises mated interlocking geometries between the truck and the track. A clamping mechanism is disposed on the truck for temporarily clamping opposing sides of the truck to the track at a desired position along the track and a contact piece having a non-marring, wear resistant surface is affixed to the truck. The contact piece is disposed for referencing against a guiding edge for a workpiece relative to the fastener delivery point. The truck can comprise a symmetrical shape such that the truck can be alternately engaged to the track with the clamping mechanism on a left side of the fastener hand tool or with the clamping mechanism on a right side of the fastener hand tool.

18 Claims, 9 Drawing Sheets

(58) Field of Classification Search

CPC ..... A47B 2210/0083; A47B 2210/091; A47B 2210/175; A47B 46/005; A47B 49/006; A47B 51/00; A47B 57/583; A47B 57/585; A47B 61/003; A47B 77/10; A47B 77/16; A47B 88/423; A47B 88/437; A47B 88/44; A47B 88/443; A47B 88/46; A47B 88/467; A47B 88/47; A47B 88/473; A47B 88/477; A47B 88/483; A47B 88/487; A47B 88/75; A47B 88/90; A47B 88/931; A47B 88/956; A47B 88/969; A47B 96/027; A47B 96/06; A47B 96/1416; A47B 96/1466; A47B 9/16

USPC ..... 227/110, 140, 120, 111, 148; 160/194, 160/201, 197, 202, 210

See application file for complete search history.

(56) References Cited

U.S. PATENT DOCUMENTS

| | | | | |
|---|---|---|---|---|
| 2,587,134 | A | 2/1950 | Flora | |
| 2,915,754 | A | 12/1959 | Wendel | |
| 2,989,101 | A * | 6/1961 | Carmien | B25D 1/02 81/19 |
| 3,615,049 | A * | 10/1971 | Obergfell et al. | B25C 1/005 227/28 |
| 3,821,973 | A * | 7/1974 | Carmien | B25D 1/02 81/25 |
| 4,390,115 | A * | 6/1983 | Bigham | B05C 17/0123 222/326 |
| 5,012,702 | A * | 5/1991 | Taylor | B25D 1/02 81/25 |
| 5,261,588 | A * | 11/1993 | Lin | B25C 7/00 227/110 |
| 5,267,682 | A * | 12/1993 | Okouchi | E04D 15/02 227/120 |
| 5,408,902 | A * | 4/1995 | Burnett | B25D 1/12 30/308.1 |
| 5,628,445 | A * | 5/1997 | Braddock | B25C 7/00 227/120 |
| 5,649,661 | A | 7/1997 | Masuno et al. | |
| 6,119,912 | A * | 9/2000 | Peck | B25C 7/00 173/20 |
| 6,161,744 | A * | 12/2000 | Mukoyama | B25C 7/00 227/120 |
| 6,431,428 | B1 * | 8/2002 | Chen | B25C 1/00 227/119 |
| 6,672,497 | B2 * | 1/2004 | Lin | B25C 1/003 227/120 |
| 7,029,080 | B2 * | 4/2006 | Barry, Jr. | H05K 7/1489 312/333 |
| 7,055,728 | B2 | 6/2006 | Lin | |
| 7,310,879 | B1 | 12/2007 | Clarke et al. | |
| 7,575,140 | B2 | 8/2009 | Jiang | |
| 7,654,430 | B2 | 2/2010 | Cho et al. | |
| 7,699,201 | B2 * | 4/2010 | Hagan | B25C 1/003 227/120 |
| 8,056,785 | B2 | 11/2011 | Gosis et al. | |
| 8,231,188 | B1 * | 7/2012 | Chen | A47B 88/57 312/333 |
| 8,585,166 | B2 * | 11/2013 | Chen | A47B 88/493 312/333 |
| 2004/0011845 | A1 | 1/2004 | Walter | |
| 2005/0145670 | A1 | 7/2005 | Huang | |
| 2006/0091178 | A1 * | 5/2006 | Lin | B25C 7/00 227/110 |
| 2006/0162174 | A1 | 7/2006 | Vick | |
| 2006/0176654 | A1 * | 8/2006 | Kfoury | G06F 1/1624 361/679.56 |
| 2007/0188060 | A1 * | 8/2007 | Nussbaumer | A47B 88/40 312/333 |
| 2009/0084824 | A1 | 4/2009 | Jian | |
| 2009/0152323 | A1 * | 6/2009 | Lin | B25C 7/00 227/148 |
| 2009/0266867 | A1 | 10/2009 | Mina et al. | |
| 2011/0108212 | A1 * | 5/2011 | Bennett, III | E06B 3/485 160/201 |
| 2012/0228330 | A1 * | 9/2012 | Gardner | B05B 12/002 222/174 |
| 2014/0366688 | A1 * | 12/2014 | Bocanegra Marquina | B25D 1/02 81/25 |

OTHER PUBLICATIONS

Artek, Duravar UHMW-PE Ultra-High Molecular Weight Polyethylene, Sep. 2013, Arteck (Year: 2013).*

European Patent Application No. 16808225.3 Extended European Search Report of International Application No. PCT/US2016/036523, dated Nov. 28, 2018.

PCT International Search Report and Written Opinion of International Application No. PCT/US2016/036523, dated Sep. 8, 2016.

'Devidoir adhesif double face mousse VHB—derouleur manuel' (Adezif) [online] retrieved from ,URL: https:/twww.youtube.com/watch?v=HshKvfRA3F, Apr. 3, 2014.

Brozek, "Selected Plastics Wear Resistance to . . .," Acta Universitatis Agriculturae et Silviculturae Mendelianae Brunensis, 63(2): 387-393.

* cited by examiner

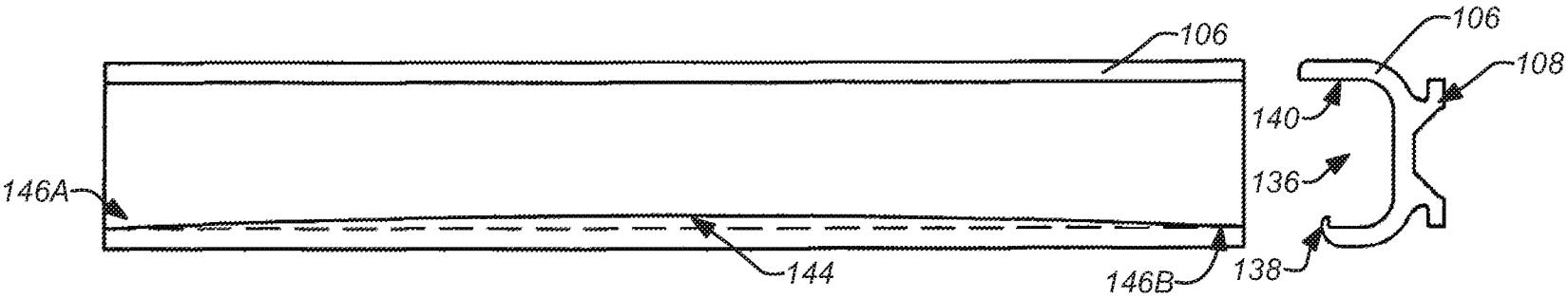
FIG. 3B
FIG. 3A
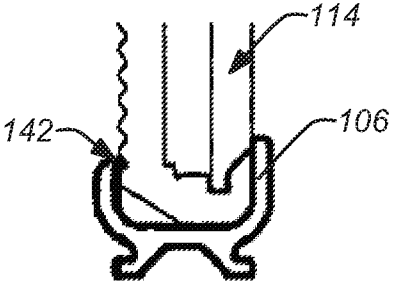
FIG. 3C

GUIDE FOR A FASTENER HAND TOOL

CROSS-REFERENCE TO RELATED APPLICATIONS

This application claims the benefit under 35 U.S.C. § 119(e) of the following U.S. provisional patent application, which is incorporated by reference herein:

U.S. Provisional Patent Application No. 62/230,565, filed Jun. 8, 2015, and entitled "Nail gun guide," by Paul Eugene Fiala.

BACKGROUND OF THE INVENTION

1. Field of the Invention

This invention relates to fastener hand tools. Particularly, this invention relates to instruments for guiding the operation of hand tools for placement of a fastener media, including, but not limited to, pins, nails, staples or a rivets, caulking, tape, and adhesive.

2. Description of the Related Art

In various applications, different types of hand tools are used to dispense a fastening media such as nails, staples, rivets, caulking, tape, adhesive or numerous other types of fasteners. An individual user holds the tool, directs the operating end to a desired location, and activates the tool to deliver the fastening medium to the desired location. In one example, a nail gun (which can be powered by compressed air, electric power, combustion, or any other known power system) is configured to be held in one hand. The user directs the driver tip to a desired location, e.g. the surface of a wood workpiece at a location having a second wood workpiece directly behind it. The user then depresses a trigger causing the nail gun to rapidly drive a nail at the desired in a single power stroke penetrating both wood workpieces such that the nail fastens the two wood workpieces together. Other driven fasteners, such as staples and rivets can be delivered by similar hand tools.

In contrast, applied fastener media, such as caulking, tape or adhesive can be dispensed from hand tools such that when the user depresses an operating trigger, the fastening media is delivered continuously until the trigger is released. In this case, the fastening media is applied to a first workpiece surface and a second workpiece is positioned onto the first workpiece after application with the fastening media therebetween to form a bond.

In general, however, all such fastener hand tools are designed to dispense their respective fastener medium under the free hand direction of the user. Thus, such tools typically provide no means to conveniently and precisely control the placement of the fastener medium in a reapeatable manner, e.g. yielding a straight line of fasteners. This deficiency can often result in a variety of problems, particularly from less skilled users.

For example, haphazard placement of the fastener media can present a unprofessional appearance. Driven fastener media can be disposed in a flawed manner exiting the finished product in unacceptable locations yielding a visually unacceptable result. Such improper placement of the fastener media can also result inadequate fastening strength between workpieces due to misalignment of the fastener media. Some of these problems can be so severe that the finished product is unacceptable and must be completely redone. In addition, dispensing the fastener media without a guide can be significantly slower and therefore substantially more expensive. In addition, mistakes are the enevitable consequence of ordinary human error. Such mistakes can cost significant time and money to revisit and correct, reducing profits. Some tools for guiding the operation of the fastener hand tools have been developed.

U.S. Pat. No. 5,261,588 by Lin, issued Nov. 16, 1993, discloses an auxiliary slidable abutment is pivotally mounted on the nail cartridge of a nailing gun in such manners that it slides in a direction consistent with axis of the nail cartridge, and that it can be locked at any given point of its sliding course, and further that its bottom extends downward beyond the nail cartridge. It provides the nailing gun with the capability of doing things, such as driving with precision the nails onto a workpiece at the prescribed intervals, driving the nails with precision onto the fastened area of a horizontal board and a vertical board, and driving the nails onto a workpiece at a prescribed angle and with precision.

U.S. Patent Application Publication No. 2009/0152323 by Lin, published Jun. 18, 2009, discloses a position scale for a nail gun includes a scale member, a positioning member, and an extending member. The scale member is mounted on the nail gun with a zero scale aligned with a muzzle of the nail gun. The positioning member is detachably mounted on the scale member for reciprocation along the scale member with a position portion as an index of the scale marks of the scale member. The extending member is detachably mounted on the positioning member with an extending position portion vertical to the scale member, wherein the extending member is distal to the nail gun than the positioning member.

In view of the foregoing, there is a need in the art for apparatuses and methods for guiding the operation of fastener hand tools. There is a need for such apparatuses and methods to aid in controlling the delivery of the fastening with precision and repeatability. There is also a need for such devices to improve the speed and efficiency in dispensing the fastening medium and to do so while reducing the likelihood of errors. These and other needs are met by the present invention as detailed hereafter.

SUMMARY OF THE INVENTION

A guide for a fastener hand tool is disclosed including a truck having slidable engagement with a track affixed to the fastener hand tool. The slidable engagement comprises mated interlocking geometries between the truck and the track. A clamping mechanism is disposed on the truck for temporarily clamping opposing sides of the truck to the track at a desired position along the track and a contact piece having a non-marring, wear resistant surface is affixed to the truck. The contact piece is disposed for referencing against a guiding edge for a workpiece relative to the fastener delivery point. The truck can comprise a symmetrical shape such that the truck can be alternately engaged to the track with the clamping mechanism on a left side of the fastener hand tool or with the clamping mechanism on a right side of the fastener hand tool.

A typical embodiment of the invention comprises a guide for a fastener hand tool including a truck having slidable engagement with a track affixed to the fastener hand tool and having one end disposed proximate to a fastener delivery point of the hand tool, the slidable engagement comprising mated interlocking geometries between the truck and the track, a clamping mechanism disposed on the truck for temporarily clamping opposing sides of the truck to the track at a desired position along the track, and a contact piece having a non-marring, wear resistant surface affixed to the truck, the contact piece disposed for referencing a guiding edge for a workpiece relative to the fastener delivery point. The track can include a marked scale showing position of the truck relative to the fastener delivery point.

The mated interlocking geometries between the truck and the track can be symmetric such that the truck can be alternately engaged to the track with the clamping mechanism operated from a left side of the fastener hand tool or with the clamping mechanism operated from a right side of the fastener hand tool.

In a typical embodiment of the invention, the clamping mechanism can comprise a threaded joint spanning opposing sides of the truck. The threaded joint can include a captured nut disposed within a box section on one of the opposing sides of the truck. In addition, the threaded joint can comprise a thumb screw or a cam lock on the other side of the truck.

In some embodiments of the invention, the contact piece can comprise a disc having a hole therethrough and a pin through the hole affixes the contact piece in a channel within the truck. The channel of the truck can include ribs for securing the pin and engagement of the clamping mechanism clamping opposing sides of the truck to the track can simultaneously clamp the pin within the channel of the truck. The pin can engage the truck to be aligned parallel with the track and with the surface of the contact piece perpendicular to the track. The channel can also be open to both a front end and a rear end of the truck and the contact piece can be alternately engaged in either the front end or the rear end of the channel. The non-marring, wear resistant surface can comprise a nylon, a ultra-high-molecular-weight (UHMW) polyethylene, or a polytetrafluoroethylene (PTFE) material.

In further embodiments of the invention, the track can comprise a separate component affixable to the hand tool such that the one end of the track is disposed proximate to the fastener delivery point of the hand tool. The separate component can include a channel for engaging a bottom edge of the hand tool, the channel having opposing inner edges and tongue along one of the opposing inner edges, the tongue having a taper high spot in the middle and reduced heights at both ends. Alternately, the track can be integral to the fastener hand tool. In either case, the track can extend beyond a back end of the fastener hand tool.

Embodiments of the invention can include fastener hand tools dispensing a driven fastener medium selected from the group consisting of nails, pins, rivets and staples or fastener hand tools dispensing an applied fastener medium selected from the group consisting of caulk, tape, or adhesive.

BRIEF DESCRIPTION OF THE DRAWINGS

Referring now to the drawings in which like reference numbers represent corresponding parts throughout:

FIGS. 3A to 3C show an exemplary attachable track for use with the exemplary embodiment of the invention for guiding operation of a fastener hand tool;

DETAILED DESCRIPTION OF THE PREFERRED EMBODIMENT

1. Overview

Figure 1C:
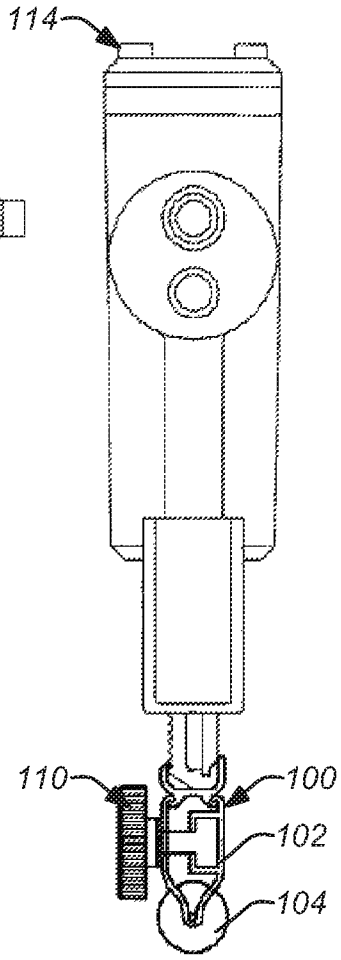
FIGS. 1A to 1C show front, side, and back views, respectively of an exemplary embodiment of the invention for guiding operation of a fastener hand tool.

As previously mentioned, embodiments of the invention encompass a guide for a fastener hand tool. The guide includes a truck having slidable engagement with a track affixed to the fastener hand tool. The slidable engagement comprises mated interlocking geometries between the truck and the track. The guide can be implemented with a separate attachable track to the fastener hand tool or with an integral track built into the tool. A clamping mechanism is disposed on the truck for temporarily clamping opposing sides of the truck to the track at a desired position along the track and a contact piece having a non-marring, wear resistant surface is affixed to the truck. The contact piece is disposed for referencing against a guiding edge for a workpiece relative to the fastener delivery point.

The guide can facilitate both left-right and front-back functional symmetry. The truck can employ a configuration such that it can be alternately engaged to the track with the clamping mechanism on a left side of the fastener hand tool or with the clamping mechanism on a right side of the fastener hand tool. Thus, the truck is left-right functionally symmetric. Similarly, the contact piece can be engaged to either the front end or back end of the truck and employed. In this manner, the guide is also front-back functionally symmetric.

It should be noted that, although example embodiments of the invention are described herein with respect to an example nail gun, those skilled in the art will understand that the novel guide for a fastener hand tool is readily applicable to any suitable type of fastener hand tool for dispensing a range of fastener media. The differences in the detailed designs of the various types of fastener hand tools can be readily accommodated implementing an embodiment of the invention as described herein without undue experimentation. Accordingly, a fastener hand tool as referenced herein refers to any hand tool, power, pneumatic, manual, hydraulic, etc. that dispenses any kind of fastener media, including, but not limited to, a nail gun, a screw gun, a staple gun, a caulking gun, a rivet gun, a tape dispenser or any other suitable fastener media hand tool as will be understood by those skilled in the art. Typically, an applicable fastener hand tool can dispense a fastener medium in either a driven or applied form.

Driven media such as nails, pins, rivets or staples can be delivered individually from a fastener hand tool with a quick forced impact from the delivery point of the tool with each pull of the trigger. Such driven fastener hand tools can be powered by compressed air, combustion gases, electric linear motor or any other suitable drive source.

Applied fastener medium such as caulk or adhesive can be dispensed from a fastener hand tool continuously from the delivery point of the tool as long as pressure is applied to the trigger. Such applied fastener hand tools can be powered by the user's hand pressure (although a powered heating element may be used to liquify some types of adhesive). A fastening media such as tape can be drawn out of an unpowered hand tool, pulled from an end that is initially fastened to the workpiece.

2. Exemplary Guide for a Fastener Hand Tool

Figure 1B:
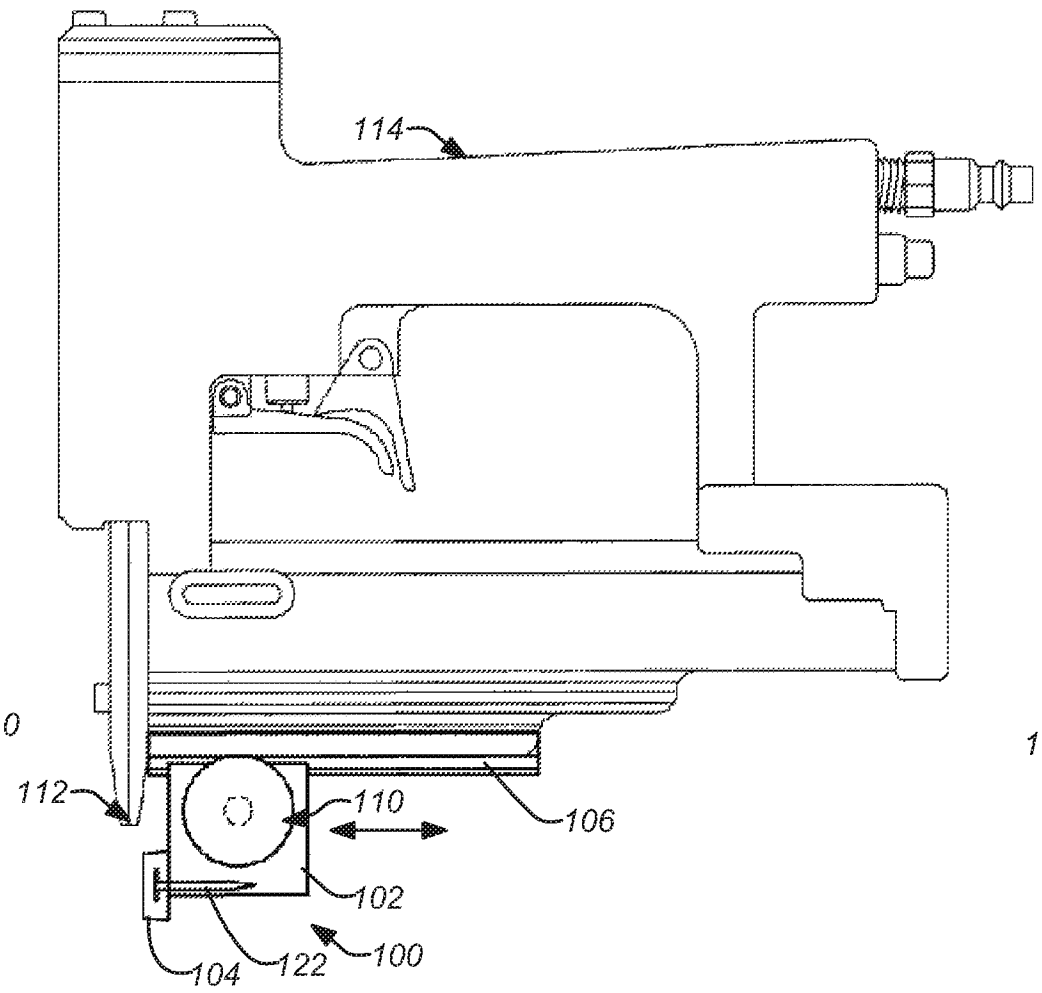
Figure 1A:
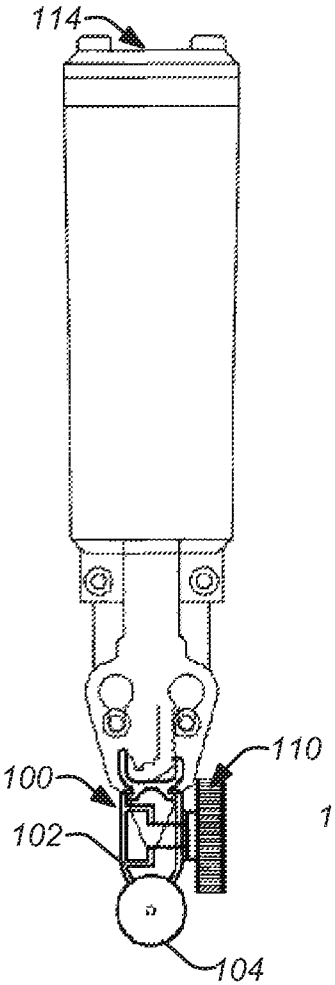

FIGS. 1A to 1C show front, side, and back views, respectively of an exemplary embodiment of the invention for guiding operation of a fastener hand tool 114. The guide 100 comprises a simple, compact system including a truck 102 and a contact piece 104. Typically, the contact piece 104 is affixed to the truck 102 with a pin 122 (e.g. bolt, nail, or any suitable post with a head) that is engaged through a hole in the contact piece 104 into the truck 102. The truck 102 is slidably engaged with a track 106 (or rail) that is affixed to the fastener hand tool with one end of the track 106 disposed nearer to a fastener delivery point 112 of the hand tool 114 than the opposite end. The guide 100 also includes a clamping mechanism 110 disposed on the truck 102 for temporarily clamping opposing sides of the truck 102 to the track 106 at a desired position along the track 106 by the user.

Figure 1D:
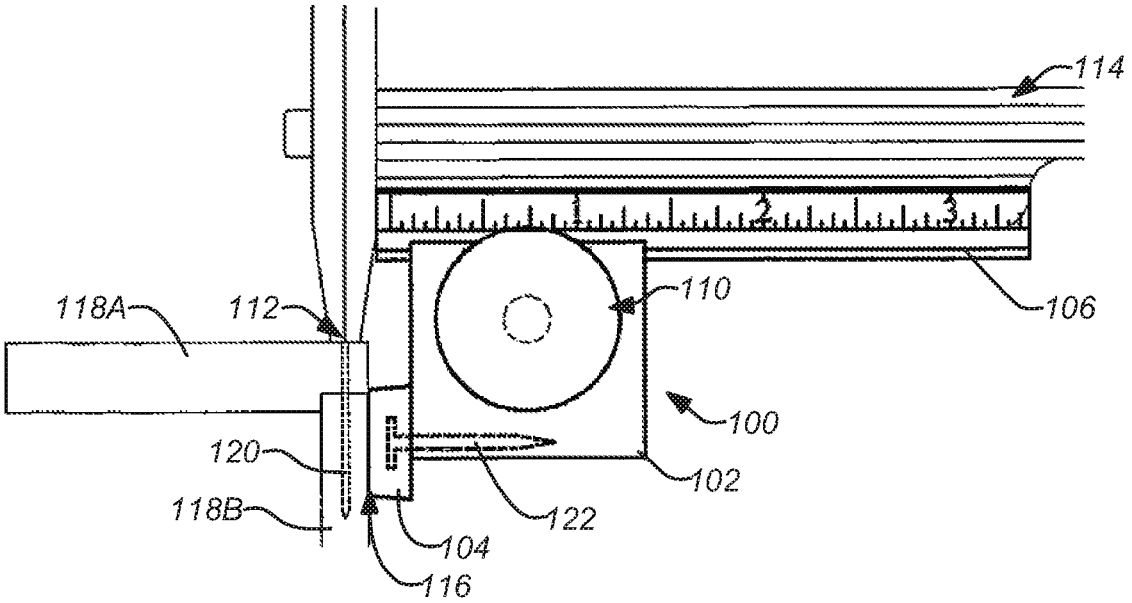
FIGS. 1D and 1E show side views of the exemplary embodiment of the invention for guiding operation of a fastener hand tool in use positioning a fastener medium relative to a reference edge in different positions along the track.
Figure 1E:
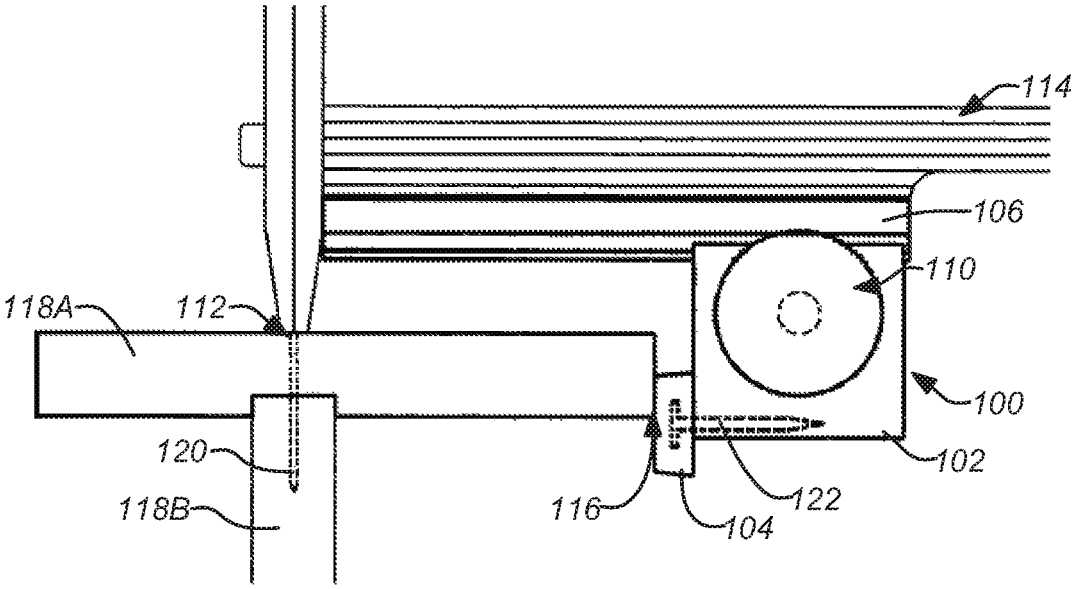

FIGS. 1D and 1E show side views of the exemplary embodiment of the invention for guiding operation of a fastener hand tool 114 in use positioning a fastener medium relative to a reference edge 116 in different positions along the track 106. FIG. 1D shows the guide 100 with the truck 102 clamped on the track 106 in a position very near the fastener delivery point 112 as appropriate for the relative distance between the guiding edge 116 and the fastener delivery point 112. In contrast, FIG. 1E shows the guide 100 with the truck 102 clamped on the track 106 in a position very distant from the fastener delivery point 112 due to the more distant guiding edge 116. FIG. 1D also shows the track 106 including a marked scale showing position of the truck relative to the fastener delivery point, which can optionally be included with any embodiment described herein. The marked scale can be integrated into the track by laser etching, machining, stamping, printing, bonding with adhesive or any other suitable process.

In both cases, the user directs the fastener delivery point 112 of the fastener hand tool 114 to a desired location based on the guide contact with the reference edge 116. With the truck 102 properly positioned on the track 106, the fastener delivery point 112 on the surface of a workpiece 118A is automatically located such that the second workpiece 118B is directly behind it. Thus, the user can operate the fastener hand tool 114 with confidence even though he may not be able to see the location of the second workpiece 118B.

Activation of the fastener hand tool 114 by the user causes the fastener medium 120, e.g. a nail, to be delivered penetrating both workpieces 118A, 118B such that the fastener medium 120 secures the two workpieces 118A, 118B together. Location of the next fastener is quickly identifed by the user by simply moving the fastener hand tool 114 along the reference edge 116 (in a direction perpendicular to the track 106).

It should be noted that in the case of applied fastener media, such as caulking, tape or adhesive, the guide 100 is used in the same manner except that the fastener medium 120 is applied directly to the surface of the workpiece 118A. The second workpiece is then positioned onto the first workpiece 118A surface after application with the fastener media therebetween to form a bond. Although there is no blind fastening with applied fastener media such as caulking, tape or adhesive, the user still benefits significantly by being able to deliver a straight line of fastener media as applied fastener media is delivered continuously until the trigger is released. Thus, applied fastener media types benefit from the control maintained by the guide 100 as the fastener hand tool 114 is moved along the reference edge 116 (in a direction perpendicular to the track 106) continuously delivering the fastener media.

Figure 2B:
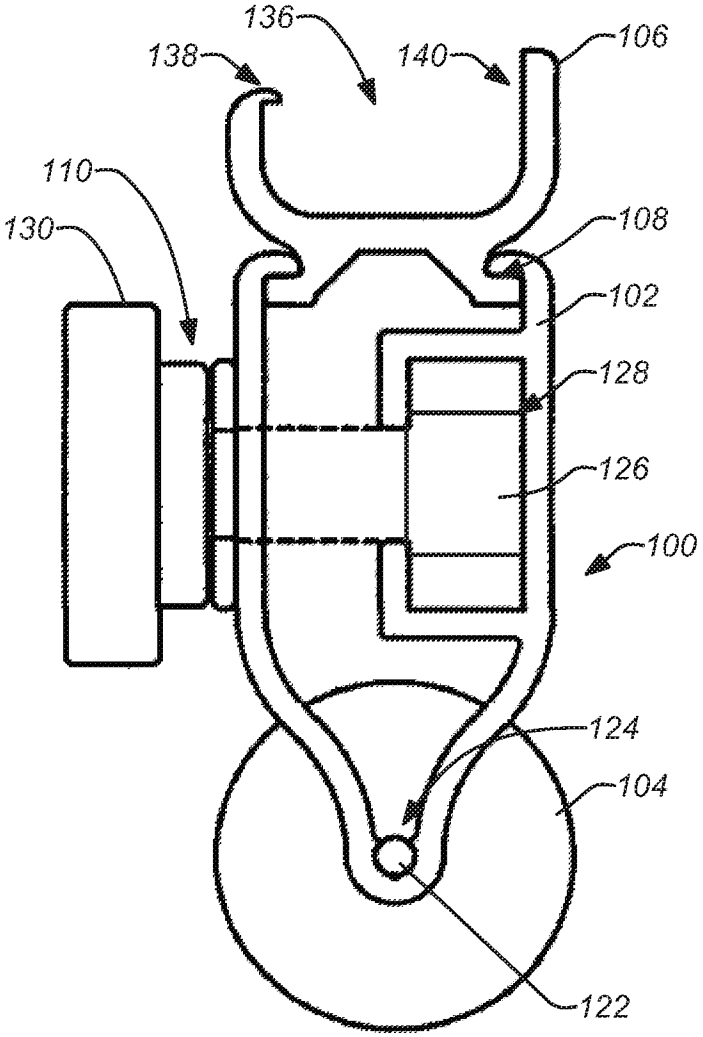
FIGS. 2A and 2B show side and back views of an exemplary embodiment of the invention for guiding operation of a fastener hand tool.
Figure 2A:
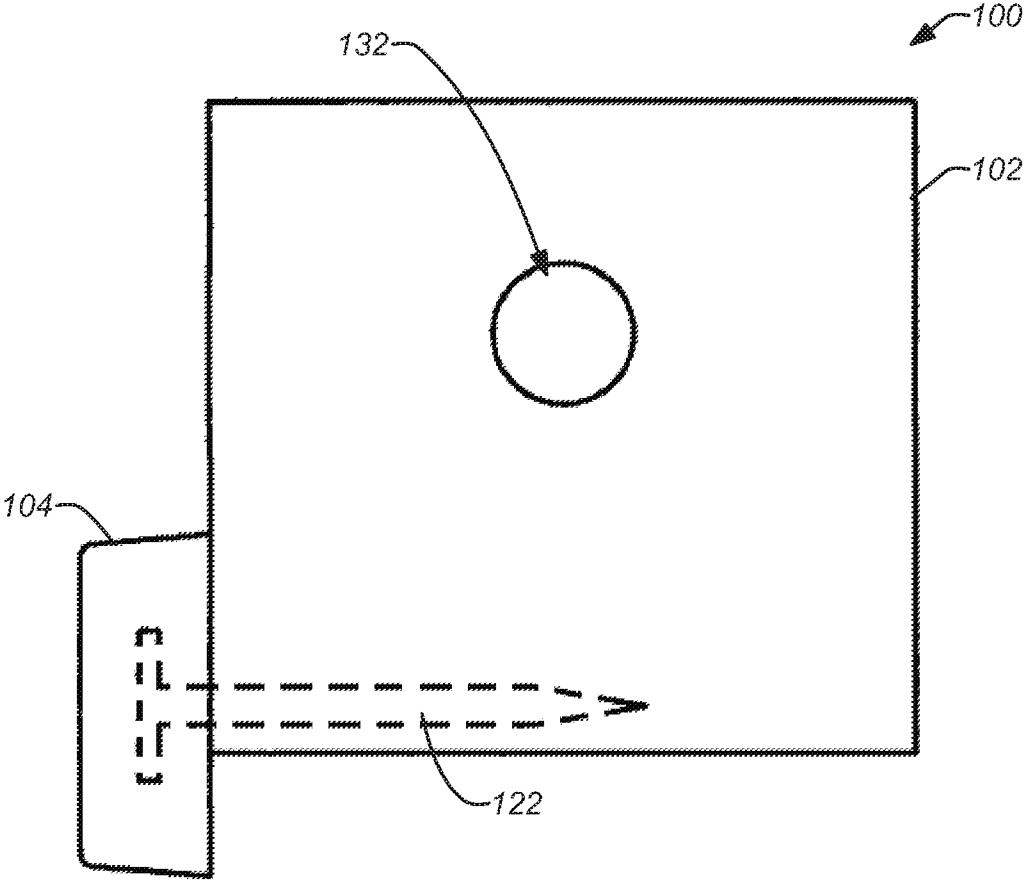

FIGS. 2A and 2B show close up side and back views of an exemplary embodiment of the invention for guiding operation of a fastener hand tool 114. The slidable engagement between the truck 102 and track 106 is accomplished through mating interlocking geometries 108 on each. In one example, the mating interlocking geometries 108 comprise two opposing tongues on the truck 102 which engage matching outward facing slots on the track 106. Typically, the gap between the interlocking profiles may only be a few thousandths of a inch allowing the interlocking geometries to freely slide between each other. Once the geometries are interlocked, the truck 102 can only be moved linearly back and forth along the track 106 and can only be disengaged from the track 106 by being moved beyond one end of the track 106. The interlocking geometries of the truck 102 are part of a contiguous element.

The truck 102 can be produced from any suitably strong structural material, such as a metals like steel or aluminum. Lighter metals are preferred to minimize weight added to the hand tool. In addition, although it is possible to produce the truck 102 as a machined part, the slidable engagement between the truck 102 and track 106 through mating interlocking geometries 108 makes these elements ideally suited for manufacturing production through an extrusion process, such as with extruded aluminum, as will be understood by those skilled in the art.

The slidable engagement between the truck 102 and track 106 can employ any suitable interlocking geometries 108 can be used as will be understood by those skilled in the art. For example, the opposing tongues can alternately be disposed on the track 106 with the slots on the truck 102 and/or the tongues and slots can comprise more complex geometric key and matching keyway designs. A symmetrical design for the interlocking geometries 108 such as this is necessary for enabling the left-right functional symmetry as further described hereafter with respect to FIGS. 4A and 4B.

Another example of suitable (but asymmetrical) interlocking geometries is shown by the attachment of the track 106 to the fastener hand tool 114. See FIGS. 1C and 2B. In this case, a channel has a single tongue (or lip) on one side and a flat backing surface on the opposing side. The single tongue engages a slot on one side of the fastener hand tool 114 with the flat backing surface braced on the other side. See FIGS. 1C and 3C. These interlocking geometries 108 can also provide a slidable engagement if they are incorporated between the truck 102 and the track 106 (or the truck 102 and directly to the fastener hand tool 114 as described hereafter with reference to FIGS. 5A to 5C).

The contact piece 104 affixed to the truck 102 employs a non-marring, wear resistant surface. The contact piece 104 is designed so that it can be used against finish workpiece surfaces without causing damage or requiring cleaning. Accordingly, the contact piece 104 can be made from nylon, ultra high molecular weight (UHMW) polyethylene, polytetrafluoroethylene (PTFE) or any other suitable known material. The contact piece 104 can be affixed to the truck 102 with a pin 122 (e.g. bolt, nail, or any suitable post with a head) that is engaged through a hole in the contact piece 104 into the truck 102.

Engagement to the truck 102 is made by inserting the pin 122 into a channel 124 in the truck 102. The channel 124 extends through the length of the truck 102 and is open to both a front end and a rear end of the truck 102. In addition, the channel 124 includes a pair of ribs on opposing sides which secure the pin 122 in place. When engaged with the truck 102, the pin 122 is aligned to be parallel with the track 106 and with the surface of the contact piece 104 perpendicular to the track 106. Because the channel is open at both ends, the contact piece 104 can be alternately engaged in either the front end or the rear end of the channel 124. This enables front-back functional symmetry as previously mentioned. See FIG. 6 described hereafter.

Figure 2C:
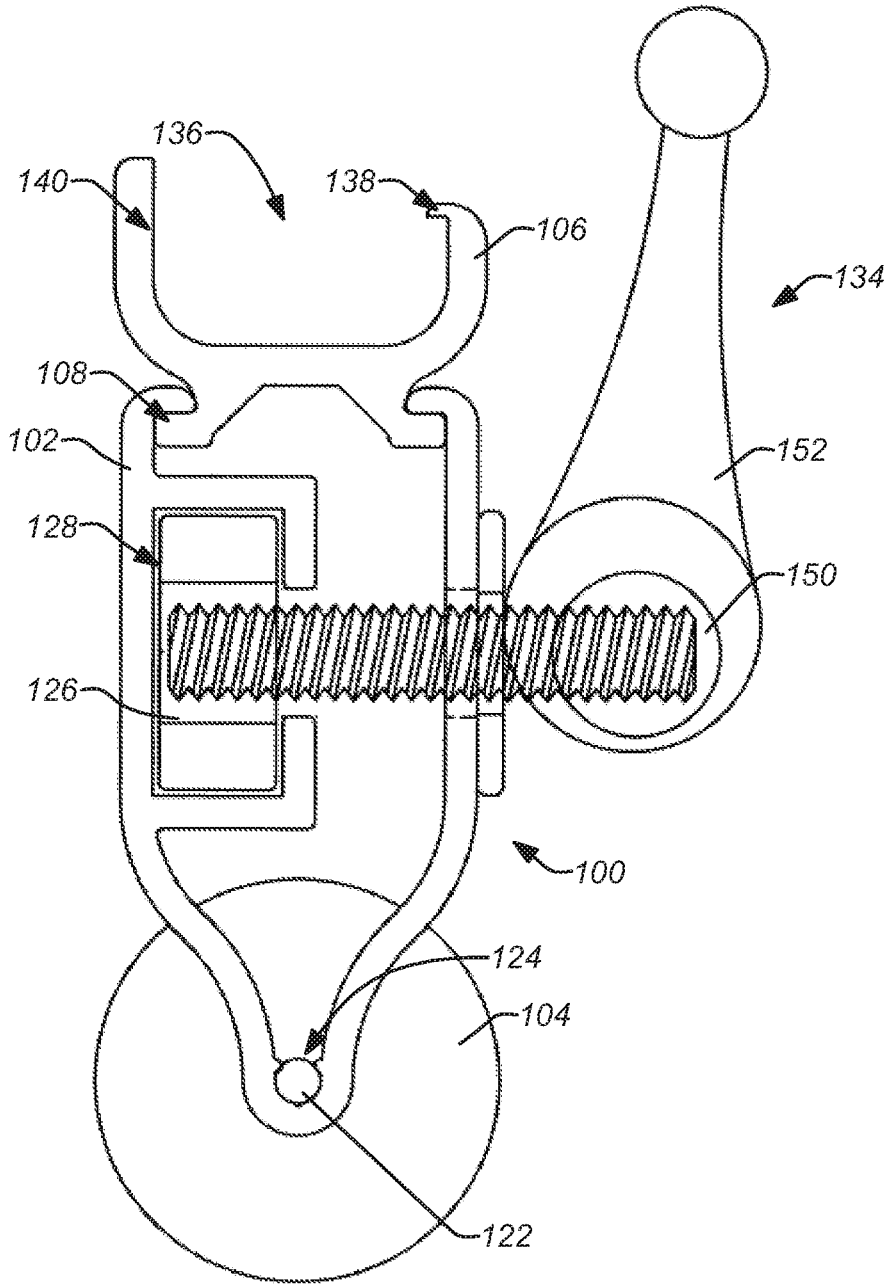
FIG. 2C shows a back view of an exemplary embodiment of the invention for guiding operation of a fastener hand tool employing a cam lock clamping mechanism.

As previously described, the guide 100 also includes a clamping mechanism 110 disposed on the truck 102 for temporarily clamping opposing sides of the truck 102 to the track 106 at a desired position along the track 106 by the user. The clamping mechanism 110 can be implemented as a threaded joint spanning opposing sides of the truck 102. In one example, the threaded joint includes a captured nut 126 disposed within a box section 128 on one of the opposing sides of the truck 102. A thumb screw 130 (or wing nut) engages the threaded joint through a hole 132 on the opposite side of the truck 102. In another example, the clamping mechanism can be implemented as a cam lock 134 on the opposite side of the truck 102. See FIG. 2C. The cam lock 134 comprises a member (e.g. threaded member) engaging a fixed center 150 that is in turn rotatably engaged to a lever 152 having a variable radius (depending upon lever position) against a fixed surface. Those skilled in the art will appreciate that any other suitable known clamping mechanism can be implemented for clamping opposing sides of the truck 102 to the track 106 as well.

It should be noted due to the design of the truck 102 having an overall channel configuration with two opposing sides that each engage the track 106, when the clamping mechanism 110 is engaged it simultaneously clamps the truck 102 to the track 106 and also pinches the pin 122 to become locked in the channel 124. Thus, the clamping mechanism 110 serves a dual function.

3. Attachable Track with Tapered Engagement

FIGS. 3A to 3C show an exemplary attachable track for use with the exemplary embodiment of the invention for guiding operation of a fastener hand tool 114. As previously mentioned, the track 106 includes an interlocking geometry 108 to engage the truck 102. On the opposite side the track 106 also includes a channel 136 with a single tongue 138 (or lip) on one side and a flat backing surface 140 on the opposing side. The single tongue 138 engages a slot 142 on one side of the fastener hand tool 114 with the flat backing surface 140 braced against the other side.

In addition, the track 106 can employ a novel attachment feature to the fastener hand tool 114. The tongue 138 is tapered along the length of the track 106 such that it has a high spot in the middle 144 and reduced heights at both ends 146A, 146B. A full height tongue across the length of the track 106 would be very difficult to install as the tongue forms an interference fit across the entire distance. Accordingly, the tapered tongue 138 reduces the length of the interference fit resulting in a good balance between secure engagement of the track 106 to the tool 114 and making the track 106 removeable by hand. Adjustment of the interference fit can be readily achieved with minor crimping of the channel 136, particularly in the area of the high spot in the middle 144.

4. Left-Right Functional Symmetry

Figure 4A:
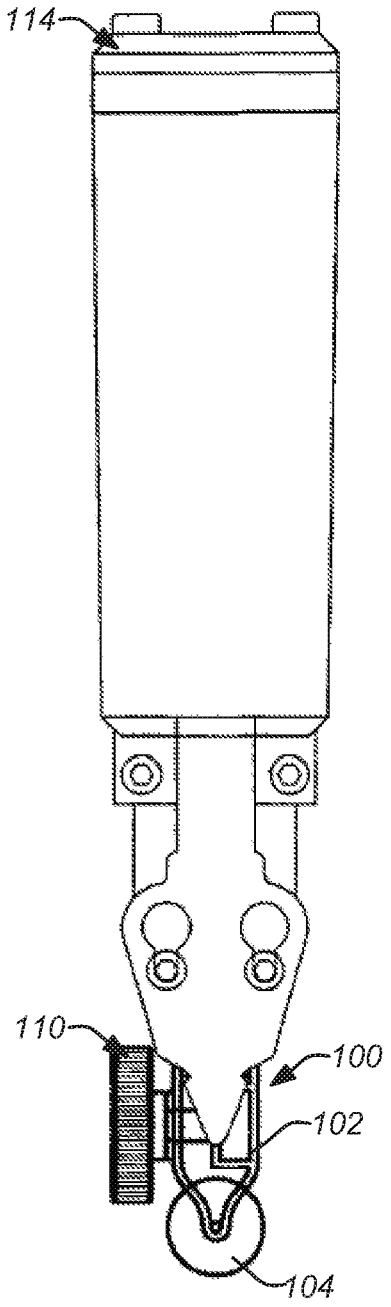
FIGS. 4A and 4B show front views of an exemplary embodiment of the invention for guiding operation of a fastener hand tool with left and right functional symmetry.
Figure 4B:
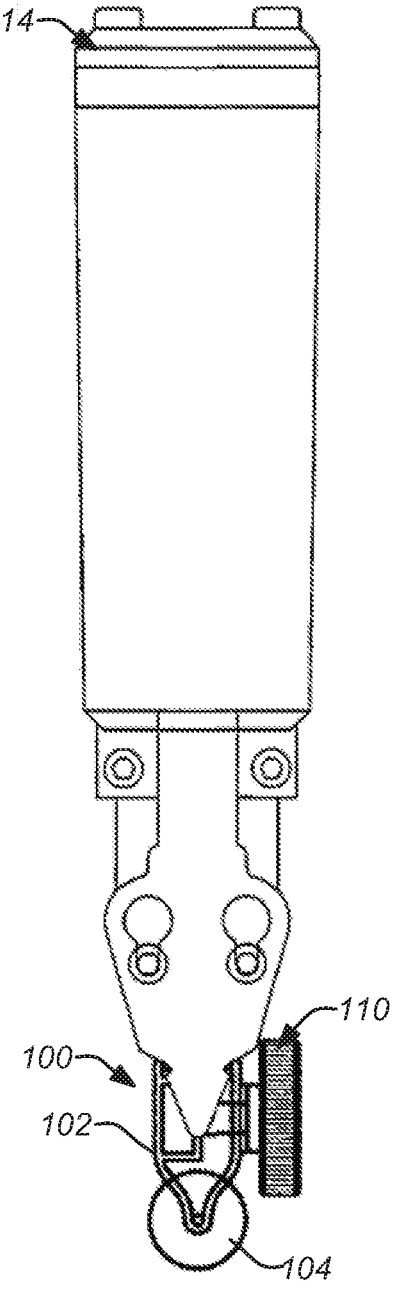

FIGS. 4A and 4B show front views of an exemplary embodiment of the invention for guiding operation of a fastener hand tool 114 with left and right functional symmetry. As previously mentioned, a symmetrical design for the interlocking geometries 108 is required for enabling the left-right functional symmetry. This allows the truck 102 to be installed onto the track 106 in either direction as shown. As previously described, the clamping mechanism 110 is operated from one side of the truck 102. Accordingly, if the truck 102 can be installed and operated in either direction, the clamping mechanism 110 can be used from either the left or right side of the fastener hand tool 114 as desired by the user as shown.

It is important to note that this left-right functional symmetry also requires that the contact piece 104 can be installed symmetrically front to back as well as previously described. This is necessary because, if the truck 102 is reversed, the contact piece 104 will be reversed as well. If the user desires to use the guide in the same mode, e.g. with the contact piece surface facing the fastener delivery point 112, the contact piece 104 must be positioned on the opposite side of the truck 102 as well. As previously described, the engagement channel 124 for the pin 122 of the contact piece 104 being open to both ends of the truck 102 enables this reversible installation of the contact piece 104.

5. Integral Fastener Hand Tool Track

Figure 5A:
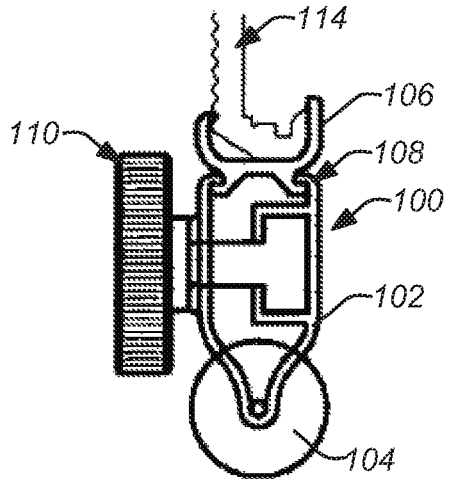
FIGS. 5A and 5B show front views of embodiments of the invention employing a separate track piece and an integral track, respectively, for guiding operation of a fastener hand tool.
Figure 5B:
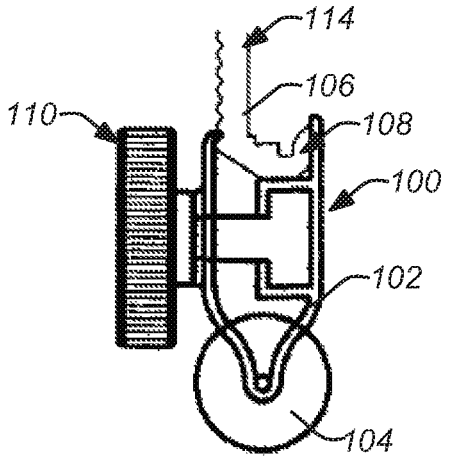
Figure 5C:
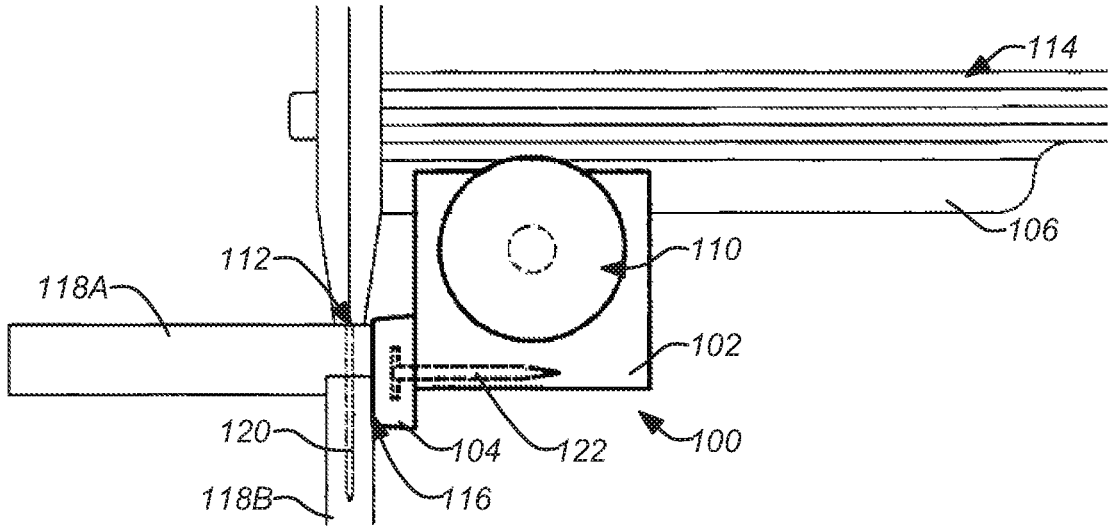
FIG. 5C shows a side view of an integral track for guiding operation of a fastener hand tool.

FIGS. 5A and 5B show front views of embodiments of the invention employing a separate track piece and an integral track, respectively, for guiding operation of a fastener hand tool. As previously mentioned, embodiments of the invention can be implemented with a separate track 106, e.g. as described in FIGS. 3A to 3C, or with an integral track 106 built into the fastener hand tool 114. FIG. 5A shows the separate track 106 configuration, whereas FIG. 5B shows an example embodiment employing an integral track 106. In this case, the interlocking geometry 108 is configured to engage directly a track 106 integrated into the fastener hand tool 114 as shown. It is important to note that, although the integral track 106 is shown with an asymmetric interlocking geometry 108, the integral track 106 can be readily configured with a symmetric interlocking geometry 108 such as previously described, e.g. in FIG. 2B. FIG. 5C shows a side view of an integral track 106 for guiding operation of a fastener hand tool 114.

6. Front-Back Functional Symmetry

Figure 6:
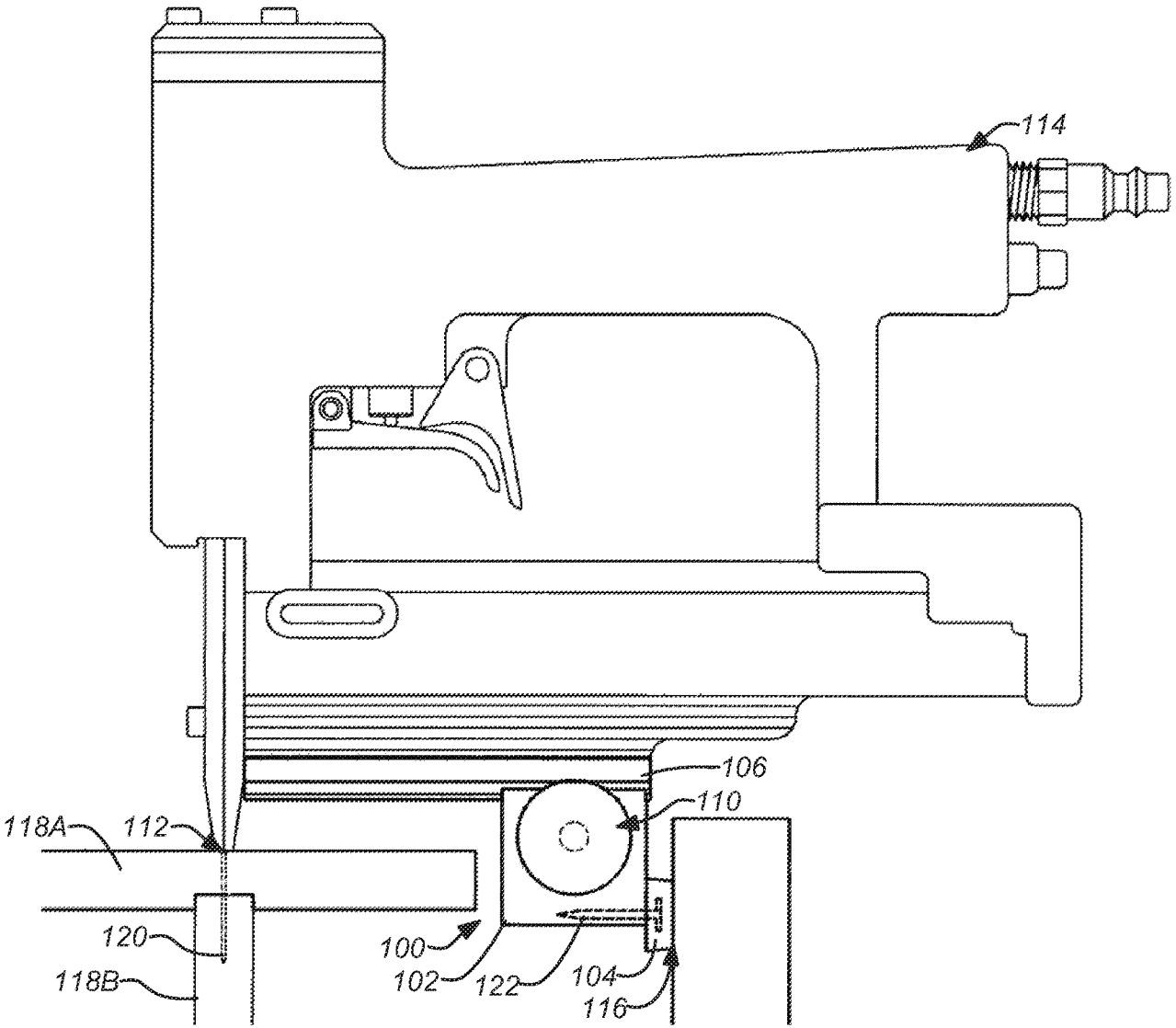
FIG. 6 shows a side view showing operation of an embodiment of the invention employing a reversed contact piece.

FIG. 6 shows a side view showing operation of an embodiment of the invention employing a reversed contact piece 104. This illustrates an alternate operating mode for the guide 100 employing the contact piece 104 installed on the opposite side of the truck 102 such that the surface of the contact piece 104 is facing away from the fastener delivery point 112. This allows the user to employ the guide 100 if the reference edge 116 is disposed facing towards the fastener delivery point 112 as shown.

It should be noted that the height of the truck 102 may interfere with the workpieces 118A, 118B in some installations. Embodiments of the invention are not limited to a truck 102 having the relative height as shown in the figures. Those skilled in the art will a truck 102 having a shorter height in order to reduce the chances of interference in use is well within the scope of the described embodiments.

7. Extended Track

Figure 7:
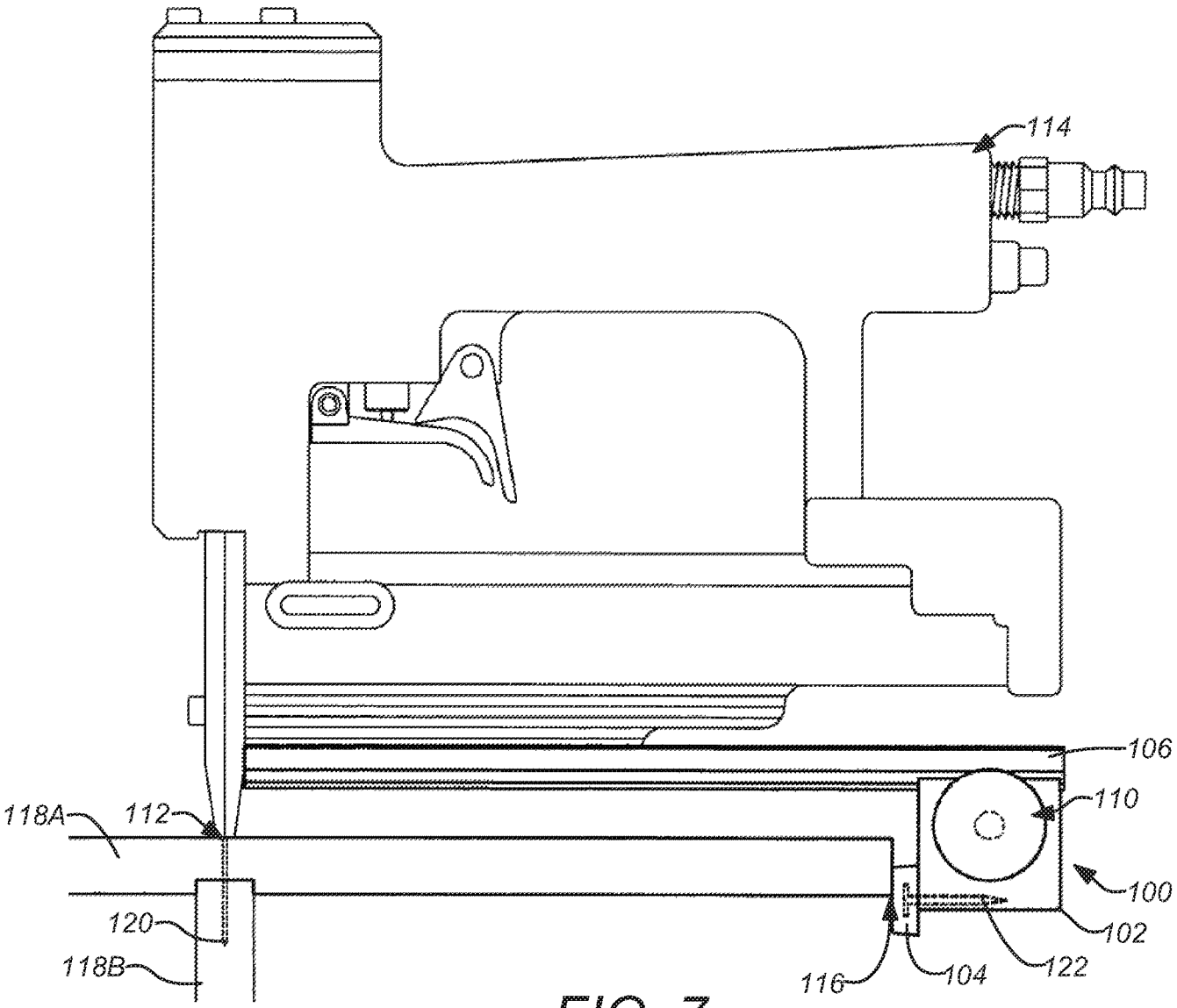
FIG. 7 shows a side view showing operation of an embodiment of the invention employing an extended track.

FIG. 7 shows a side view showing operation of an embodiment of the invention employing an extended track 106 beyond the back end of the fastener hand tool 114. Just as the height of the truck 102 can be varied as described above, the length of the track 106 can also be varied within the scope of the invention. Embodiments of the invention can employ a track 106 of any length provided the resulting length enables a structurally stable use. An extended track 106 as shown in FIG. 7 (or longer) can be employed temporarily in an unusual fastener installation scenario. The user can opt for a shorter length track 106 in regular use.

This concludes the description including the preferred embodiments of the present invention. The foregoing description including the preferred embodiment of the invention has been presented for the purposes of illustration and description. It is not intended to be exhaustive or to limit the invention to the precise forms disclosed. Many modifications and variations are possible within the scope of the foregoing teachings. Additional variations of the present invention may be devised without departing from the inventive concept as set forth in the following claims.

What is claimed is:

1. A guide for a fastener hand tool comprising:

a truck having slidable engagement with a track affixed to the fastener hand tool and having one end disposed nearer to a fastener delivery point of the hand tool than an opposite end, the slidable engagement comprising mated interlocking geometries between the truck and the track;

a clamping mechanism disposed on the truck for temporarily clamping opposing sides of the truck to the track at a desired position along the track; and a contact piece having a non-marring, wear resistant surface affixed to the truck extending from a side of the truck adjacent the slidable engagement, the contact piece disposed for referencing a guiding edge for a workpiece relative to the fastener delivery point;

wherein the mated interlocking geometries between the truck and the track are symmetric such that the truck can be alternately engaged to the track with the clamping mechanism operated from a left side of the fastener hand tool or with the clamping mechanism operated from a right side of the fastener hand tool and wherein the contact piece comprises a disc having a hole therethrough and a pin through the hole affixes the contact piece in a channel within the truck and the pin engages the truck to be aligned parallel with the track and with the surface of the contact piece perpendicular to the track.

2. The guide of claim 1, wherein the track comprises a separate component affixable to the hand tool such that the one end of the track is disposed nearer to the fastener delivery point of the hand tool than the opposite end.

3. The guide of claim 2, wherein the separate component includes a channel for engaging a bottom edge of the hand tool, the channel having opposing inner edges and a tongue along one of the opposing inner edges, the tongue having a taper high spot in the middle for forming an interference fit with the bottom edge of the hand tool and reduced heights at both ends.

4. The guide of claim 1, wherein the track is integral to the fastener hand tool.

5. The guide of claim 1, wherein the non-marring, wear resistant surface comprises a nylon, a ultra-high-molecular-weight (UHMW) polyethylene, or a polytetrafluoroethylene (PTFE) material.

6. The guide of claim 1, wherein the channel of the truck includes ribs for securing the pin.

7. The guide of claim 1, wherein engagement of the clamping mechanism clamping opposing sides of the truck to the track simultaneously clamps the pin within the channel of the truck.

8. The guide of claim 1, wherein the channel is open to both a front end and a rear end of the truck and the contact piece can be alternately engaged in either the front end or the rear end of the channel.

9. The guide of claim 1, wherein the clamping mechanism comprises a threaded joint spanning opposing sides of the truck.

10. The guide of claim 9, wherein the threaded joint comprises a captured nut disposed within a box section on one of the opposing sides of the truck.

11. The guide of claim 9, wherein the threaded joint comprises a thumb screw on one of the opposing sides of the truck.

12. The guide of claim 9, wherein the threaded joint comprises a cam lock on one of the opposing sides of the truck.

13. The guide of claim 1, wherein the track comprises a marked scale showing position of the truck relative to the fastener delivery point.

14. The guide of claim 1, wherein the track extends beyond a back end of the fastener hand tool.

15. The guide of claim 1, wherein the fastener hand tool dispenses a driven fastener medium selected from the group consisting of nails, pins, rivets and staples.

16. The guide of claim 1, wherein the fastener hand tool dispenses an applied fastener medium selected from the group consisting of caulk, tape, and adhesive.

17. The guide of claim 1, wherein the truck can only be disengaged from the track by being moved beyond one end of the track.

18. The guide of claim 1, wherein the interlocking geometries of the truck are part of a contiguous element.

* * * * *